US006299516B1

(12) United States Patent
Tolles

(10) Patent No.: US 6,299,516 B1
(45) Date of Patent: Oct. 9, 2001

(54) SUBSTRATE POLISHING ARTICLE

(75) Inventor: Robert D. Tolles, Santa Clara, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/407,002

(22) Filed: Sep. 28, 1999

(51) Int. Cl.[7] ..... B24B 29/00
(52) U.S. Cl. ..... 451/287; 451/53; 451/56
(58) Field of Search ..... 451/53, 285, 286, 451/287, 288, 443, 56

(56) References Cited

U.S. PATENT DOCUMENTS

| | | | | |
|---|---|---|---|---|
| 3,745,722 | * | 7/1973 | Balz | 51/314 |
| 4,484,418 | * | 11/1984 | Reich et al. | 51/283 R |
| 4,728,552 | | 3/1988 | Jensen, Jr. . | |
| 4,841,680 | | 6/1989 | Hoffstein et al. . | |
| 4,927,432 | | 5/1990 | Budinger et al. . | |
| 5,081,051 | * | 1/1992 | Mattingly et al. | 437/10 |
| 5,152,917 | | 10/1992 | Pieper et al. . | |
| 5,257,478 | | 11/1993 | Hyde et al. . | |
| 5,342,419 | | 8/1994 | Hibbard . | |
| 5,348,615 | | 9/1994 | Gupta . | |
| 5,378,251 | | 1/1995 | Culler et al. . | |
| 5,489,233 | | 2/1996 | Cook et al. . | |
| 5,578,362 | | 11/1996 | Reinhardt et al. . | |
| 5,605,760 | | 2/1997 | Roberts . | |
| 5,899,792 | * | 5/1999 | Yagi | 451/6 |
| 5,900,164 | | 5/1999 | Budinger et al. . | |
| 5,957,750 | * | 9/1999 | Brunelli | 451/7 |

* cited by examiner

*Primary Examiner*—Timothy V. Eley
*Assistant Examiner*—Dung Van Nguyen
(74) *Attorney, Agent, or Firm*—Fish & Richardson

(57) ABSTRACT

A polishing layer for chemical mechanical polishing includes a frozen binder material solution which has a liquid state at room temperature, and solid particles dispersed in the frozen binder material. The solid particles may be abrasives, such as colloidal silica or alumina, and/or non-reactive particles, such as pieces of polyurethane or polymerized resins. The polishing layer can also include a chemical etchant. The frozen polishing pad can be formed and reconditioned in situ.

33 Claims, 7 Drawing Sheets

SUBSTRATE POLISHING ARTICLE

BACKGROUND

The invention relates to chemical mechanical polishing of substrates, and more particularly to an article for polishing a substrate.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface to provide a planar surface. Planarization, in effect, polishes away a non-planar, outer surface, whether a conductive, semiconductive, or insulative layer, to form a relatively flat, smooth surface.

Chemical mechanical polishing is one accepted method of planarization. This planarization method typically requires that the substrate be mounted on a carrier or polishing head, with the surface of the substrate to be polished exposed. The substrate is then placed against a rotating polishing pad. In addition, the carrier head may rotate to provide additional motion between the substrate and polishing surface. Further, a polishing slurry, including an abrasive and at least one chemically active agent, may be spread on the polishing pad to provide an abrasive chemical solution at the interface between the pad and substrate.

The effectiveness of a CMP process may be measured by its polishing rate and by the resulting finish (roughness) and flatness (lack of large scale topography) of the substrate surface. Inadequate flatness and finish can produce substrate defects. The polishing rate sets the time needed to polish a layer and the maximum throughput of the polishing apparatus.

A typical polishing pad is a hard composite material with a roughened polishing surface. In one example, a typical polishing pad may have a hard upper layer composed of polyurethane mixed with other fillers and a softer lower layer composed of compressed felt fibers leached with polyurethane. A two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.). The polishing pad may be attached to a rotating platen by a pressure-sensitive adhesive layer.

A slurry containing a reactive agent (e.g., deionized water for oxide polishing), abrasive particles (e.g., silicon dioxide for oxide polishing) and a chemically reactive catalyzer (e.g., potassium hydroxide for oxide polishing), is supplied to the surface of the polishing pad by a slurry supply tube. Sufficient slurry may be provided to cover and wet the entire polishing pad.

A limitation on polishing throughput is "glazing" of the polishing pad. Glazing occurs when the polishing pad is heated and compressed in regions where the substrate is pressed against it. The peaks of the polishing pad are pressed down and the pits of the polishing pad are filled up, so the surface of the polishing pad becomes smoother. As a result, the polishing time required to polish a substrate increases. Therefore, the polishing pad surface must be periodically returned to an abrasive condition, or "conditioned", to maintain a high throughput. The conditioning process is destructive and reduces the lifetime of the polishing pad.

An additional consideration in the production of integrated circuits is process and product stability. To achieve a low defect rate, each substrate should be polished under similar conditions. However, polishing pads vary from pad to pad. This variability may lead to substrate surface variability.

Another consideration about conventional polishing pads is the inefficient use of slurry. During the polishing process, a large amount of slurry is lost off the sides of the rotating polishing pad.

SUMMARY

In general, in one aspect, the invention is directed to a polishing composition for chemical mechanical polishing. The composition includes a frozen binder material that has a liquid state at room temperature, and solid particles dispersed in the frozen binder material.

Implementations of the invention may include one or more of the following features. The solid particles may include non-reactive particles, such as polyurethane or polymerizable resins, and abrasive particles, such as silica and alumina, or zirconia, silicon carbide, boron carbide, silicon nitride, titanium carbide, boron nitride, silicon nitride, diamond and manganese dioxide. The non-reactive particles may range in size between about 0.1 and 10.0 millimeters, and the abrasive particles may range in size between about 0.1 and 1.0 microns. The solid particles may form between 0% and 95%, by volume, of the polishing composition. The binder material may include water. The polishing composition may also include an etchant.

In another aspect, the invention is directed to an article for polishing a substrate. The article includes a layer of polishing material having a polishing surface. The layer including a frozen binder material that has a liquid state at room temperature and solid particles dispersed in the frozen binder material.

Implementations of the invention may include one or more of the following features. The polishing surface may include a plurality of projections or indentations. The projections or indentations may form ridges that have a width between about 1 and 4 millimeters, a height between about 0.1 and 1 millimeters, and a spacing between adjacent ridges between about 1 and 3 millimeters.

In another aspect, the invention is directed to an article for polishing of a substrate. The article includes a layer of ice, polyurethane pieces dispersed in the ice, and abrasive particles dispersed in the ice.

In another aspect, the invention is directed to a polishing apparatus. The polishing apparatus includes a platen and a layer of polishing material on the platen. The layer of polishing material including a frozen binder material that has a liquid state at room temperature, and solid particles dispersed in the frozen binder material.

Implementations of the invention may include one or more of the following features. A tube may be embedded in the layer and filled with a cooling liquid. A thermally insulating cover may be disposed over the layer of polishing material. A cloth or wire mesh may be embedded in the layer of polishing material. A ring may surround a periphery of the layer of polishing material.

In another aspect, the invention is directed to a chemical mechanical polishing apparatus. The chemical mechanical polishing apparatus has a polishing layer with a polishing surface, a cooling system to maintain the layer in a frozen state, and a carrier head to hold a lower surface of a substrate in contact with the polishing surface of the polishing layer. The polishing layer includes a frozen binder material that has a liquid state at room temperature, and solid particles dispersed in the frozen binder material.

Implementations of the invention may include one or more of the following features. A movable platen may support the polishing layer. A thermally insulating cover may cover the frozen layer. The cover may have an opening for accommodating the carrier head. The apparatus may include a polishing surface reconditioning device. The polishing surface reconditioning device may include an assembly to collect and remove debris from the polishing surface, a blade to inscribe grooves or ridges in the polishing surface, and a heater to melt the debris. The apparatus may also include an optical monitoring device, and the polishing layer may have a transparent area, e.g., formed of ice. The cooling system may have a tube embedded in the polishing layer to carry a coolant therethrough, and a source to supply the coolant to the tube.

In another aspect, the invention is directed to a method of polishing a substrate. In the method, a surface of the substrate is brought into contact with a surface of a polishing layer that includes a frozen binder material which has a liquid state at room temperature and solid particles dispersed in the frozen binder material. Relative motion is caused between the polishing layer and the substrate.

Implementations of the invention may include one or more of the following features. The polishing layer may be formed by mixing a binder material which has a liquid state at room temperature with solid particles, and freezing the mixture of the binder material and the solid particles. The layer may include a plurality of ridges that melt during polishing of the substrate surface.

In another aspect, the invention is directed to a method of forming a polishing layer for a chemical mechanical polishing apparatus. In the method, a binder material which has a liquid state at room temperature is mixed with solid particles, and the mixture of the binder material and the solid particles is frozen.

Implementations of the invention may include one or more of the following features. The solid particles may be non-reactive particles. The non-reactive particles may be composed of polyurethane or other polymerizable resins. The size of the non-reactive particles may range from about 0.1 millimeters to 10 millimeters.

The solid particles may also be abrasive particles selected from the group consisting of silica, alumina, zirconia, silicon carbide, boron carbide, silicon nitride, titanium carbide, boron nitride, silicon nitride, diamond and manganese dioxide. The size of the abrasive particles may range from about 0.1 micrometer to about 1500 micrometer. The quantity of the solid particles may range between 0% and 95% of the frozen solvent layer.

The aqueous solution may contain water and/or a liquid etchant. The polishing surface may have a plurality of ridges prior to contacting the substrate surface and the ridges may melt during polishing of the substrate surface causing the solid particles to redistribute on the substrate surface. The ridges may have a width varying between about 1 millimeter and 4 millimeters, a height varying between about 0.1 millimeter and 1 millimeter, and may be spaced between every 1 millimeters and 3 millimeters apart.

The polishing slab may have embedded in the frozen layer a tube filled with a cooling liquid. A wire mesh may also be embedded in the frozen layer providing structural support. A ring may surround the periphery of the polishing slab, and a thermally insulating cover may be disposed on top of the frozen layer.

In general, in another aspect, the invention features an apparatus for polishing a substrate. The apparatus includes a movable polishing slab wherein the polishing slab is a frozen layer of an aqueous solution which has a liquid state at room temperature, and has solid particles dispersed in the frozen layer. The apparatus also includes a cooling system for maintaining the layer frozen, and a carrier head for holding a lower surface of the substrate in contact with the polishing surface of the polishing slab.

Implementations of this aspect of the invention may include one or more of the following features. A movable platen may support the frozen polishing slab. A thermally insulating cover may cover the frozen layer and the cover may have openings to accommodate the carrier head. The apparatus may further include a polishing surface regeneration device. The polishing surface regeneration device may have a heater for melting the polishing surface, and an assembly for collecting and removing debris from the polishing surface. The apparatus may have a heater for melting the polishing slab surface. The apparatus may also have a laser interferometer for determining the end point of the polishing and the amount of the material removed from the substrate surface. The polishing slab may have a transparent area and the transparent area may be ice. The cooling system may include a tube carrying a cooling fluid embedded in the frozen layer, and a source supplying the cooling fluid to the tube.

In general, in another aspect, the invention features a method of polishing a substrate. The method includes: bringing a surface of the substrate into contact with a surface of a polishing slab, wherein the polishing slab is a frozen layer of an aqueous solution which has a liquid state at room temperature and has solid particles dispersed in the frozen layer, and causing relative motion between the polishing slab and the substrate. The polishing slab may be formed by providing an aqueous solution which has a liquid state at room temperature and has dispersed solid particles, and creating and maintaining a frozen layer of the aqueous solution.

In general, in another aspect, the invention features a method of forming a polishing slab. The method includes: mixing an aqueous solution which has a liquid state at room temperature with solid particles, and freezing the mixture of the aqueous solution with the solid particles.

Among the advantages of the invention may be one or more of the following. The frozen polishing slab does not have to be replaced between wafers because it can be regenerated and formed in situ. Since the polishing slab does not have to be replaced the inherent pad to pad variability is reduced. Because the abrasive particles and, in some embodiments, the slurry are contained in the frozen polishing slab they can be recovered and recycled. This recycling allows for a more efficient use of the abrasives and the slurry solution. Both the in situ formation of the polishing slab and the recycling of the abrasives contribute to a reduction in the polishing slab cost.

Additional features and advantages of the invention will become apparent from the following description including the drawings and the claims.

DETAILED DESCRIPTION

Figure 1:
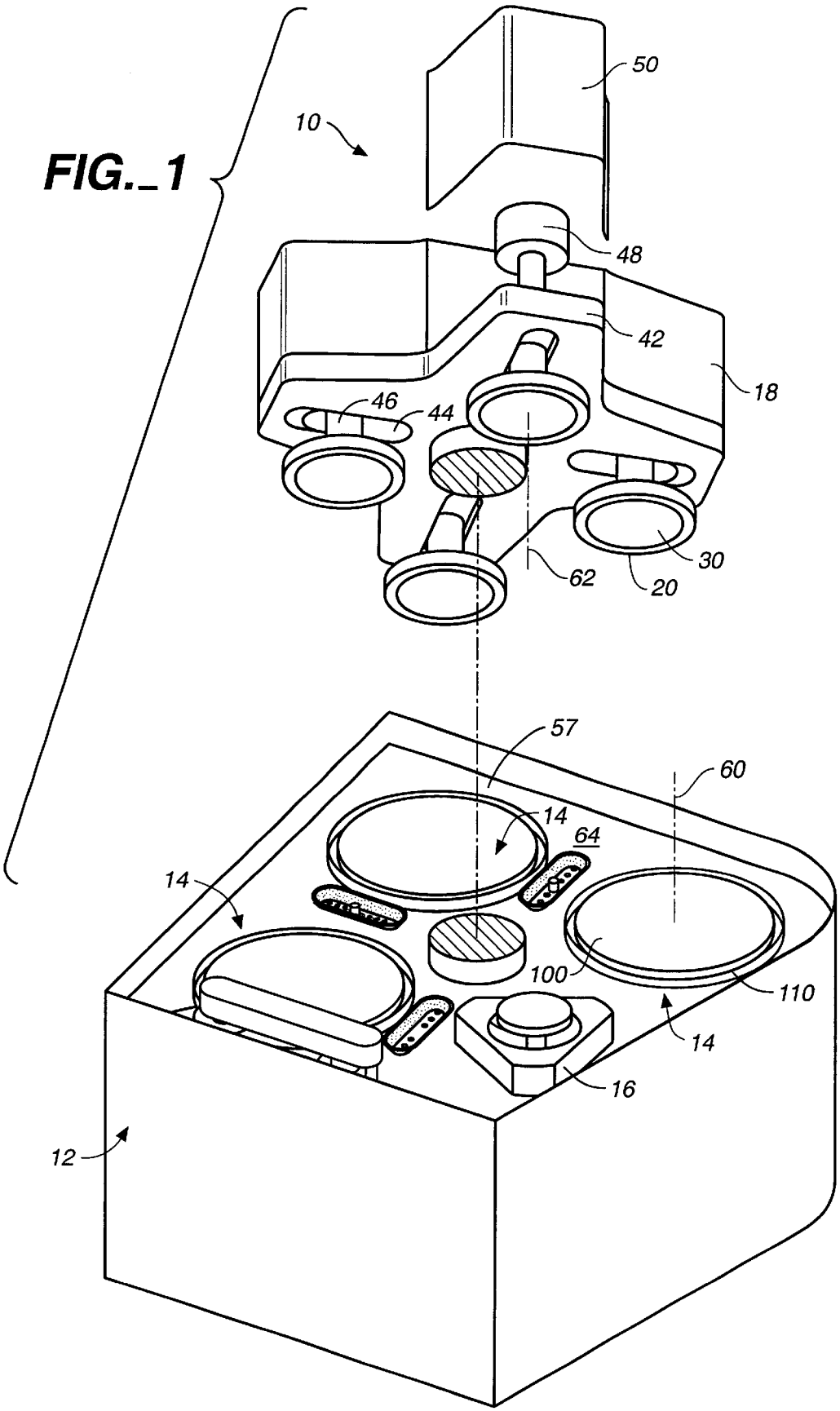
FIG. 1 is a perspective view of a chemical mechanical polishing apparatus.

Referring to FIG. 1, a polishing apparatus 10 includes three independently-operated polishing stations 14, a substrate transfer station 16, and a rotatable carousel 18 which choreographs the operation of four independently rotatable carrier heads 20. A more complete description of the polishing apparatus 10 may be found in U.S. Pat. No. 5,738,574, the entire disclosure of which is incorporated herein by reference.

Each polishing station 14 includes a rotatable platen 110 which supports a polishing slab 100. The platen 110 is mounted to a table top 57 inside the polishing apparatus 10. As will be explained in greater detail below, the polishing slab 100 is formed of a layer of frozen material embedded with abrasive particles.

In operation, a substrate 30 is into a carrier head 20 by the transfer station 16. The carousel 18 then transfers the substrate through a series of one or more of the polishing stations 14, and finally returns the polished substrate to the transfer station 16. Each carrier head 20 receives and holds a substrate, and polishes it by pressing it against the polishing slab 100 on the platen 110. A carrier drive shaft 46 connects a carrier head rotation motor 48 (shown by the removal of one-quarter of a carousel cover 50) to the associated carrier head 20 to independently rotate the carrier head about its own axis 62. In addition, each carrier head drive shaft independently laterally oscillates in a radial slot 44 formed in a support plate 42. There is one carrier drive shaft and motor for each head.

Figure 2:
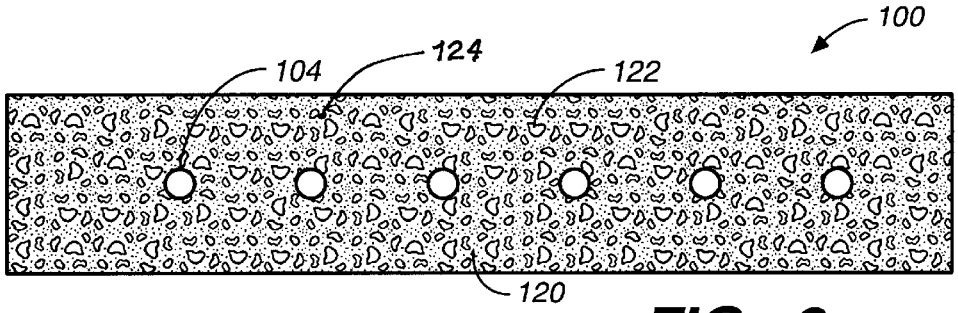
FIG. 2 is a cross-sectional side view of a frozen polishing slab.

Referring to FIG. 2, the polishing slab 100 is essentially a frozen layer of slurry mixed with conventional polishing pad material. The frozen polishing slab 100 includes a frozen binder material 120 (e.g., water ice), abrasive particles 124, and non-reactive particles 122. The binder material 120 has a liquid state at room temperature, but, when frozen, functions as a binder to hold the non-reactive and abrasive particles.

The abrasive particles 124 are composed of a hard material, such as alumina or silica, that will interact with the substrate surface to cause chemical mechanical polishing. The abrasive particles 124 could also be composed of zirconia, silicon carbide, boron carbide, titanium carbide, silicon nitride, boron nitride, diamond or manganese dioxide. The average size of the abrasive particles may vary between 0.1 microns and 1.0 microns. The abrasive particles have a Moh's hardness of at least 8, although softer particles may be used for fine polishing.

The non-reactive particles 122 are composed of a material that is generally inert in the polishing process, such as polyurethane or another polymerizable resin, e.g., a phenolic resin, aminoplast resin, or epoxy resin. The non-reactive particles 122 are durable and hard, although not as hard as the abrasive particles. The non-reactive particles 122 may be irregularly shaped pieces, such as shreds or shavings of polyurethane, or they may be roughly spherical or fiber-like. The average size of the non-reactive particles 122 may vary between 0.1 and 10 millimeters. In one example, the shredded polyurethane pieces have a thickness of about 0.25 millimeters and a length between about 6 and 8 millimeters. The non-reactive particles 122 increase the friction between the substrate and polishing surface during polishing.

A pH adjustor, such as KOH or NaOH for oxide polishing, may be mixed in the frozen polishing slab 100. For some processes, such as polishing of metals, the polishing slab may include a liquid chemical etchant, such as $FeNO_3$. Other possible additives for the frozen polishing slab 100 include oxidizers, corrosion inhibiters, biocides, and stabilizers.

The polishing characteristics of the frozen polishing slab 100 are determined by the composition and hardness of the solid particles (i.e., both the non-reactive and abrasive particles), the quantity of solid particles, and the size of solid particles. The total content of the solid particles (including abrasive and non-reactive) may be varied between 0 and 95%. The polishing rate is very low if no solid particles are present and increases proportional to the amount of the solid particles. In addition, smaller particles produce low polishing rates, whereas larger particles produce high polishing rates. Another important aspect of the particles is their ability to form a compacted surface. Small particles can be compacted easier than larger particles.

Figure 3:
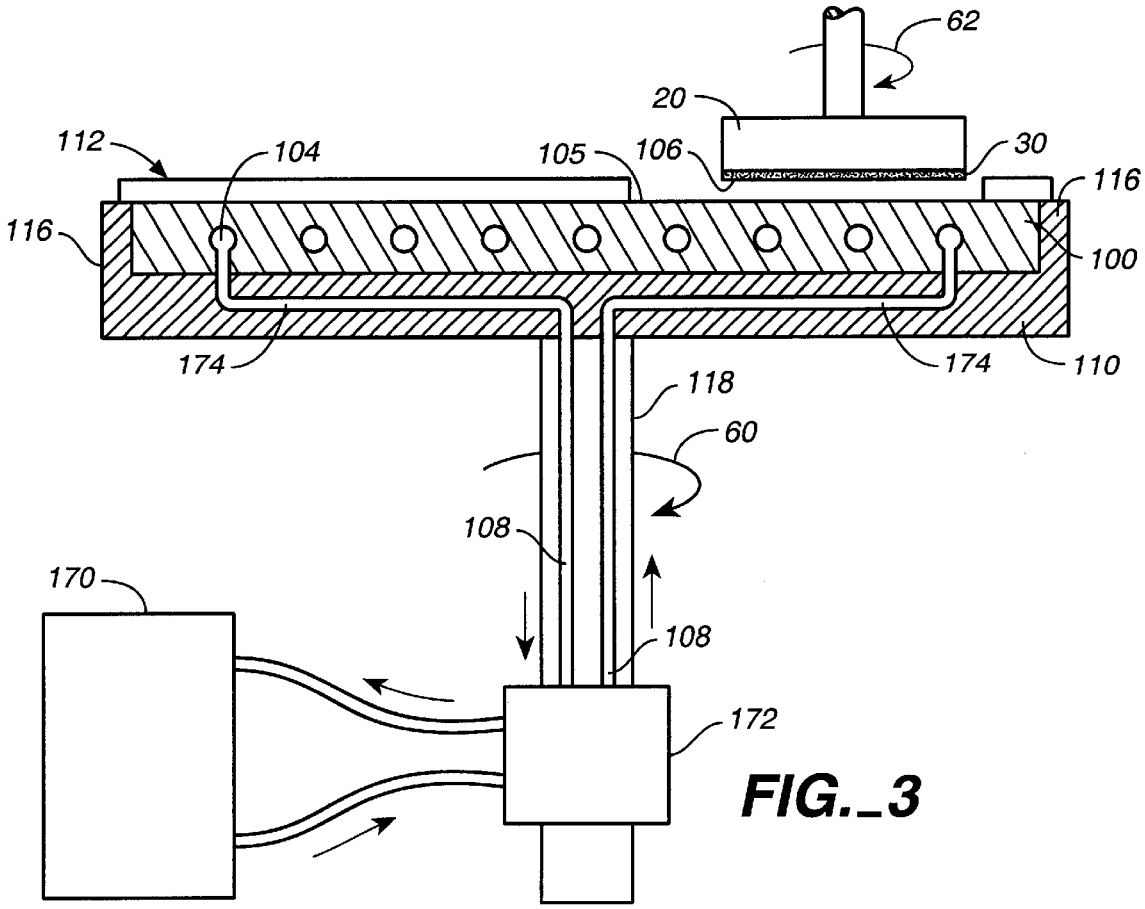
FIG. 3 is a side view of a frozen polishing slab mounted on a platen.
Figure 3A:
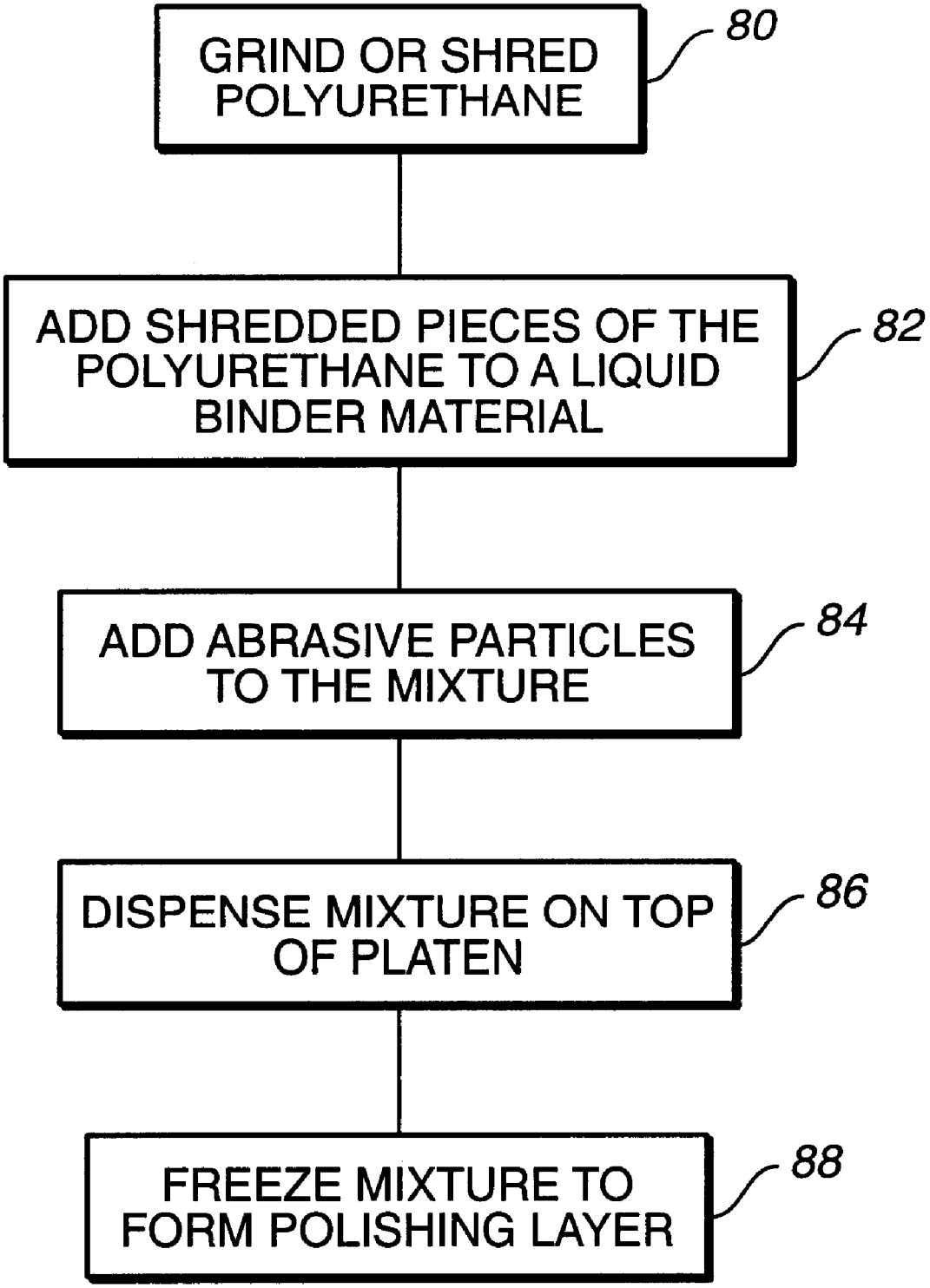
FIG. 3A is a flow diagram describing the method of fabricating a frozen polishing slab.

Referring to FIGS. 3 and 3A, frozen polishing slab 100 is formed by adding the abrasive particles to a liquid, e.g., water, to form an abrasive slurry (step 80). The abrasive particles may be added in powder form or as a slurry solution. Of course, an abrasive slurry can be obtained from a commercial vendor. A non-reactive material, e.g., polyurethane from a conventional polishing slab, is ground or shredded to form irregular polyurethane pieces (step 82), and the polyurethane pieces are added to the abrasive slurry to create a polishing precursor mixture (step 84). In one example, shredded pieces of an IC-1000 polyurethane pad from Rodel, Inc., and a SS-12 slurry from Cabot, Inc. are combined to form the polishing precursor mixture. Alternately, the polyurethane pieces could be added to the precursor mixture before the abrasive particles.

The water/polyurethane/slurry precursor mixture is then distributed on top of the platen 110 (step 86). The platen 110 has a ring 116 extending from the top surface that contains the precursor mixture on the platen. Finally, the precursor mixture is frozen on top of the platen 110 to create the polishing slab 100 (step 88). Either the polyurethane pieces or the abrasive particles, or both, could be mixed with the liquid binder on top of the platen itself to form the precursor mixture.

Figure 4:
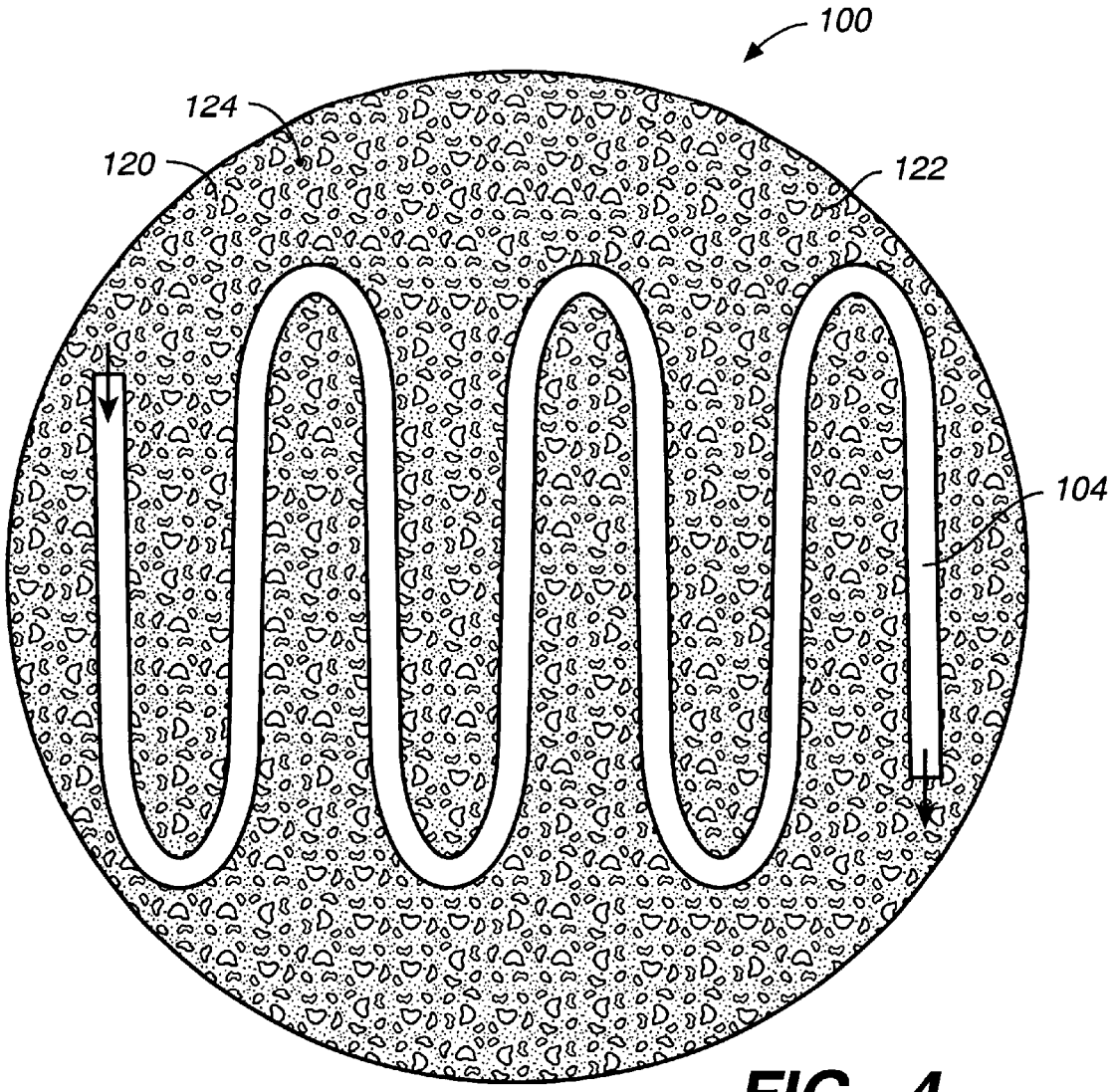
FIG. 4 is a top view of a frozen polishing slab.

The mixture is frozen, and kept at a freezing temperature, by a cooling or refrigeration system. The refrigeration system includes a coolant supply 170 that circulates a coolant through tubes 104 (see also FIG. 4) which are arranged on top of the platen 110 and embedded in the frozen slab 100. The coolant supply 170 may be connected to the tubes 104 by a rotary union 172, pipes 108 in a platen drive shaft 118, and passageways 174 in the platen 110. In one example, the coolant is liquid nitrogen. In some embodiments, the portion of the frozen polishing slab surface that does not come in contact with the substrate is covered with a thermally insulating layer or cover 112 to reduce the transfer of heat from the environment to the polishing slab.

During polishing, a top surface 105 of the polishing slab is placed in contact with the substrate surface 106, while relative motion between the substrate and the polishing slab takes place. For example, the platen 110 may rotate about an axis 60, while the carrier head rotates about axis 62. The relative motion creates local friction and heat at the interface between the slab and substrate. This heat may cause the surface of the frozen binder layer to melt locally so that the non-reactive particles and the abrasive particles are released. The polyurethane and the abrasive particles then contribute to the polishing process. However, the bulk of the polishing slab beneath the melted top layer remains frozen.

The rigidity of the polishing surface is an important factor in achieving planarization. The polishing surface must be stiff to bridge across the device features. However, if the surface is too rigid, it may fail to contact the entire wafer surface in regions, for example, where the substrate bows outward, resulting in uneven structures on the surface.

Figure 5:
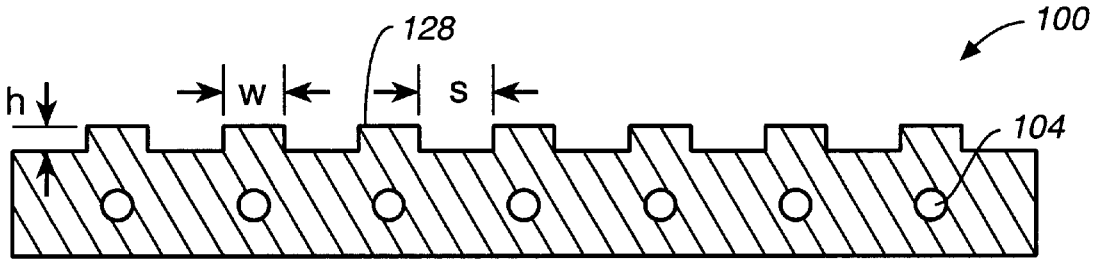
FIG. 5 is a side view of a frozen polishing slab with surface ridges.

Referring to FIG. 5, the surface of the frozen polishing slab is textured prior to and/or during engagement with the substrate surface. The texture includes ridges 128, which are crushed upon engaging with the substrate due to the heat and the load of the substrate. Crushing of the ridges redistributes the water/etchant/solid particle mixture across the surface of the wafer. This process ensures contact of the water/etchant/solid particle mixture with the entire wafer surface during the polishing operation. Specifically, the ridges are crushed by the substrate, and the crushed material is forced into areas of the substrate that are bowed inwardly, thereby ensuring uniform contact between the surface of the substrate and the polishing slab. The width w of the ridges may be between about 1 and 4 millimeters, their height h may be between about 0.1 and 1 millimeters, and they may be spaced by a distance s of about 1 and 3 millimeters.

Figure 6:
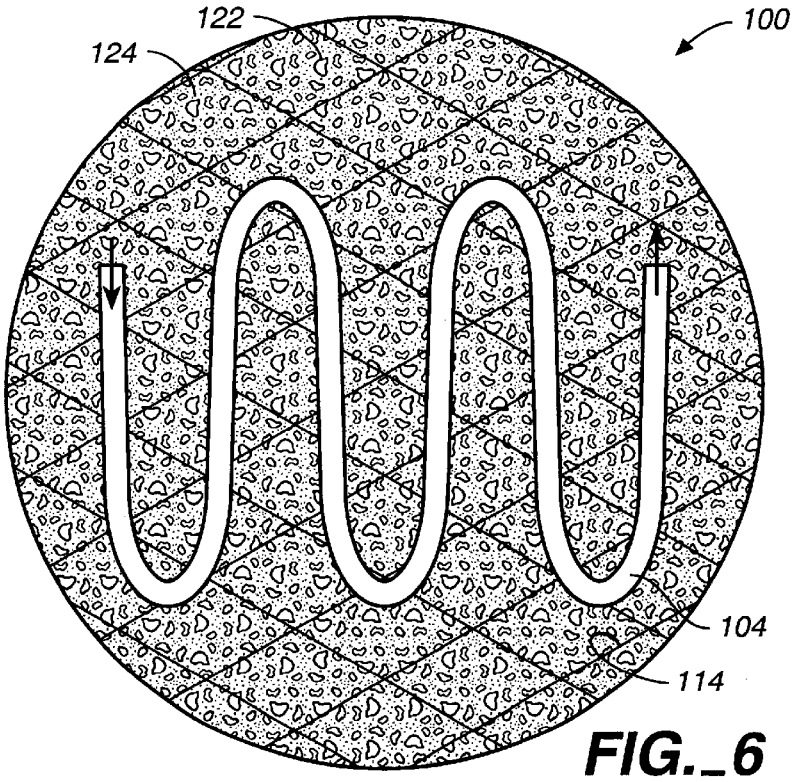
FIG. 6 is a top view of a frozen polishing slab having an embedded wire mesh.
Figure 7:
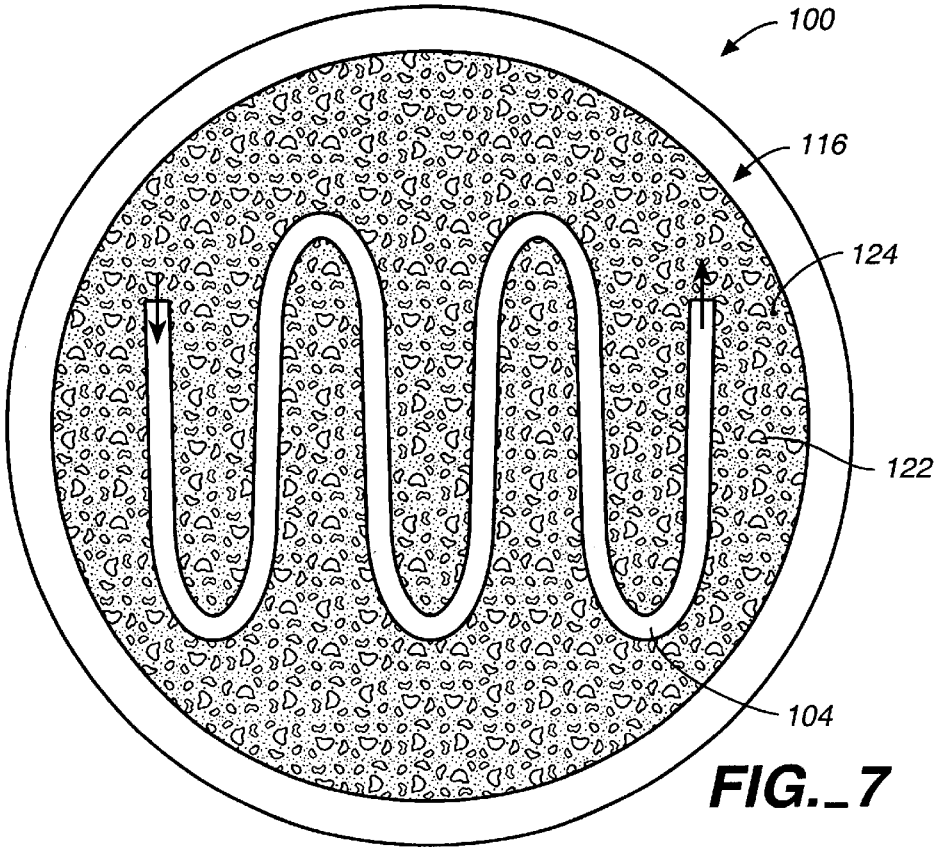
FIG. 7 is a top view of a frozen polishing slab having a ring surrounding its periphery.

During the polishing process, lateral forces develop which act on the frozen polishing slab. These lateral forces may be caused by high speed rotation of the polishing slab or may be transferred from the moving substrate. The lateral forces may cause the frozen polishing slab to crack and pieces of the slab may break away. However, referring to FIG. 6, the embedded cooling tubes 104 and the ring 116 can provide sufficient structural support for the frozen polishing slab to prevent the polishing slab from breaking. Referring to FIG. 7, additional structural support can be provided by a wire or fabric mesh 114 embedded in the frozen polishing slab 100.

Figure 8:
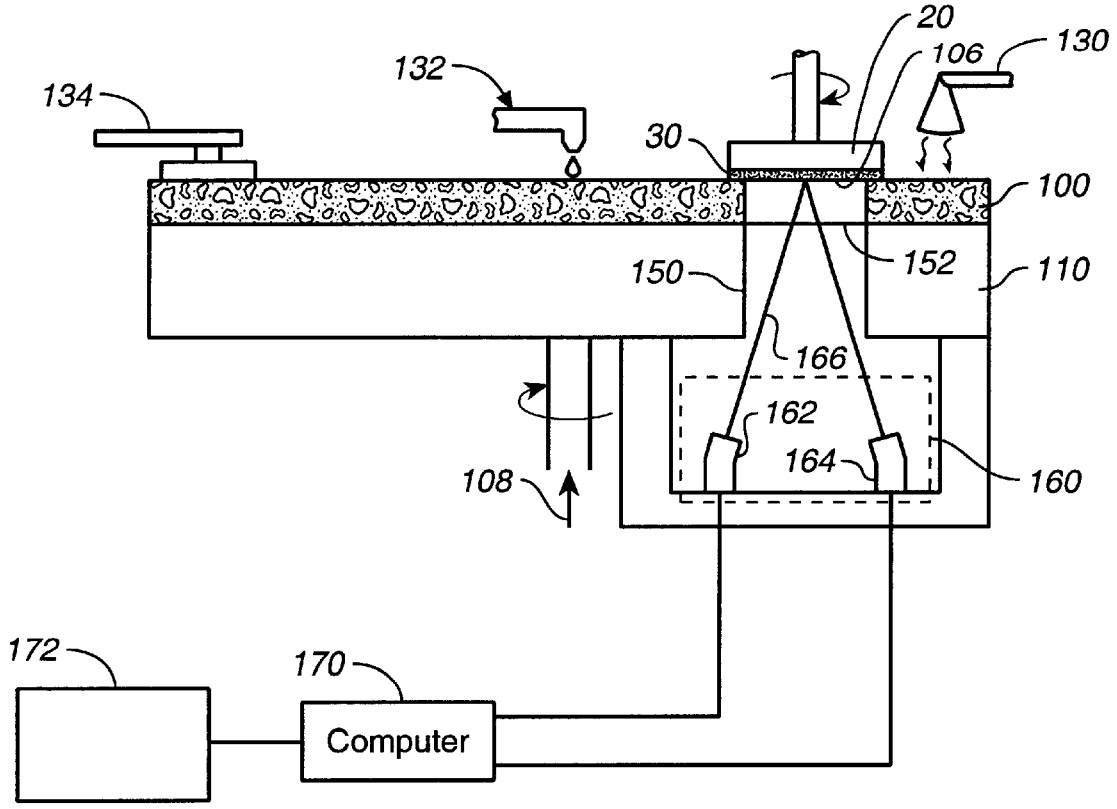
FIG. 8 is a partial side view of a polishing apparatus including a laser interferometer and a frozen polishing slab mounted on a platen.

Referring to FIG. 8, in addition to the melting that is caused by the friction during polishing, a heat lamp 130 or a resistive heater may be used to melt the surface of the polishing slab and generate a mixture of water, etchant and abrasive particles on the surface of the polishing slab.

Still referring to FIG. 8, a window 150 is formed in each platen 110, and a transparent area 152 is formed in a portion of the frozen polishing slab 100 overlying the window 150. The transparent area can be essentially a sheet of ice that does not include solid particles. The window 150 and the transparent area 152 are positioned so that they have a "view" of the substrate 30 during a portion of the platen's rotation, regardless of the translational position of the polishing head. A laser interferometer 160 is located below the platen 110. The laser interferometer includes a laser 162 and a detector 164. The laser generates a collimated laser beam 166 which propagates through the transparent area 152 to impinge upon the exposed surface 106 of the substrate 30.

In operation, the polishing apparatus 10 uses the laser interferometer 160 to determine the amount of material removed from the surface of the substrate, or to determine when the surface has become planarized. A general purpose programmable digital computer 170 may be connected to the laser 162 and the detector 164. Computer 170 may be programmed to activate the laser when the substrate 30 overlies the window 150, to store measurements from the detector, to display the measurements on an output device 172, and to detect the polishing endpoint, as described in U.S. patent application Ser. No. 08/689,930, the entire disclosure of which is incorporated herein by reference.

Figure 9:
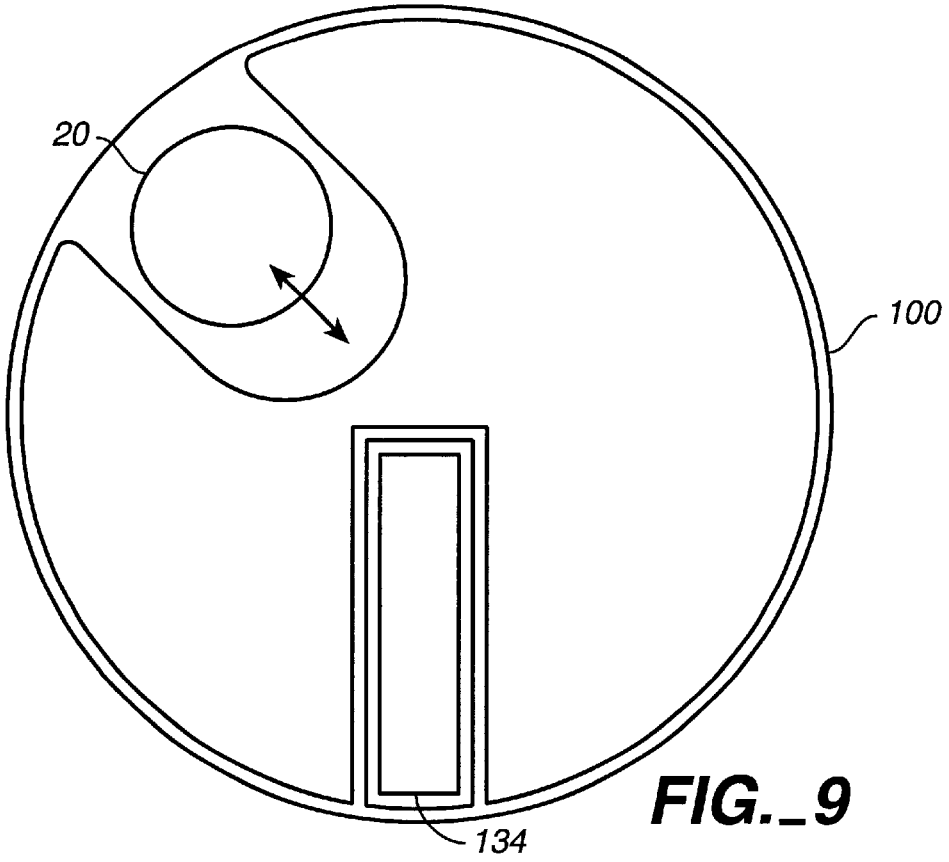
FIG. 9 is a top view of a polishing apparatus including a reconditioning device.
Figure 10:
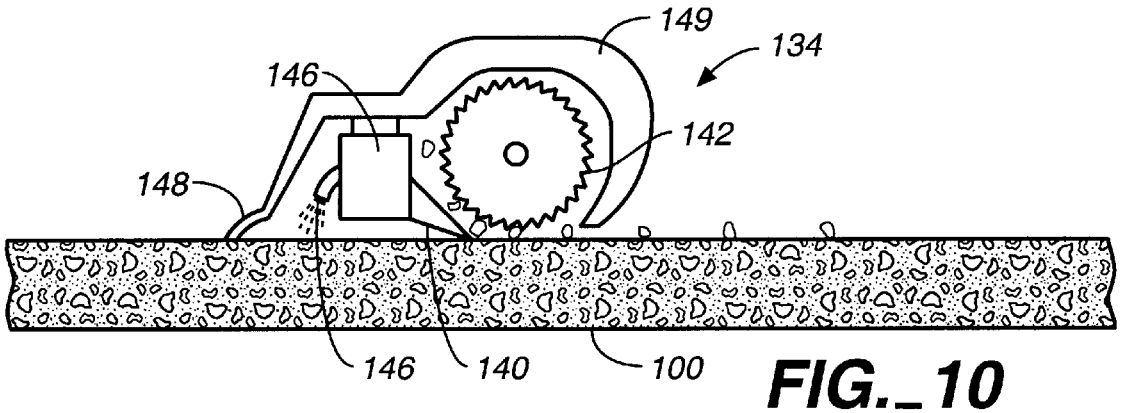
FIG. 10 is a side view of the reconditioning device of FIG. 9.

During the polishing process pieces of the polishing slab or coagulated slurry particles tend to break away and collect on the surface of the slab. The generated debris is collected by an ice resurfacing device 134 (like a "Zamboni™" machine). As the polishing slab rotates, the ice resurfacing device 134 sweeps the polishing slab surface to collect the debris. Referring to FIGS. 9 and 10, the ice resurfacing device includes a blade 140 to scrape the top surface layer and catch debris, a hard brush 142 to clean the slab surface and sweep the debris caught by the blade 140 into a tank 144, and a spray nozzle 146 to spray a mixture of liquid, solid abrasive particles, and non-reactive particles onto the polishing slab surface. The mixture from the spray freezes on contact with the polishing slab to resurface the slab and create a uniform surface texture. Then entire ice resurfacing device can be covered by a shield 149. The tank may contain a heater (not shown) that melts the debris. The melted debris may be sprayed onto the polishing slab surface, thus recycling the abrasive particles and polyurethane pieces. The ice resurfacing device 134 can also include a rake-shaped blade 148 that engages the polishing slab surface to form the ridges 128 (see FIG. 5), and a heater (not shown) for locally melting the top surface of the polishing slab.

In order to "regenerate" the polishing slab, i.e., to return the polishing slab to its original state, it need only be melted and refrozen. Alternately, the polishing slab could be melted and drained from the platen, and the abrasive particles and non-reactive particles in the slurry could be recovered and recycled. Since the slurry and polyurethane particles in the polishing slab can be reused, consumable costs are reduced. Furthermore, since the polishing slab does not have to be replaced, inherent pad to pad variability is reduced.

In another implementation, the polishing slab 100 includes only the frozen binder material and non-reactive particles. In this implementation, an optional slurry may be distributed by a slurry delivery arm 132 (see FIG. 8) onto the polishing slab and frozen during polishing. In addition, an etchant may be introduced together with the slurry by the slurry delivery arm 132. In this case, the liquid interacts with the polishing slab surface for a short time before it freezes. Alternately, the etchant could be delivered separately from the abrasive particles.

Several embodiments of the present invention have been described. Nevertheless, it will be understood that various modifications may be made without departing from the spirit and scope of the invention. Accordingly, other embodiments are within the scope of the following claims.

What is claimed is:

1. A polishing composition for chemical mechanical polishing, comprising:

a frozen binder material that has a liquid state at room temperature; and solid particles dispersed in the frozen binder material, wherein the solid particles include non-reactive particles that have a Mohs hardness of less than 8.

2. The polishing composition of claim 1 wherein the non-reactive particles include polyurethane.

3. The polishing composition of claim 1 wherein the non-reactive particles include polymerizable resins.

4. The polishing composition of claim 1 wherein the non-reactive particles range have a size between about 0.1 and 10.0 millimeters.

5. The polishing composition of claim 1 wherein the solid particles include abrasive particles.

6. The polishing composition of claim 5 wherein the abrasive particles are selected from the group consisting of silica and alumina.

7. The polishing composition of claim 5 wherein the abrasive particles are selected from the group consisting of zirconia, silicon carbide, boron carbide, silicon nitride, titanium carbide, boron nitride, silicon nitride, diamond and manganese dioxide.

8. The polishing composition of claim 5 wherein the abrasive particles have a size between about 0.1 and 1.0 microns.

9. The polishing composition of claim 1 wherein the binder material includes water.

10. The polishing composition of claim 1 further comprising an etchant.

11. The polishing composition of claim 1 wherein the solid particles form between 0% and 95%, by volume, of the polishing composition.

12. An article for polishing a substrate, comprising:

a layer of polishing material having a polishing surface, the layer including a frozen binder material that has a liquid state at room temperature and solid particles dispersed in the frozen binder material, wherein the polishing surface includes a plurality of projections or indentations.

13. The article of claim 12 wherein projections or indentations form ridges that have a width between about 1 and 4 millimeters, a height between about 0.1 and 1 millimeters, and a spacing between adjacent ridges between about 1 and 3 millimeters.

14. An article for polishing of a substrate, comprising:

a layer of ice;

non-reactive particles dispersed in the ice; and abrasive particles dispersed in the ice, wherein the abrasive particles are harder than the non-reactive particles.

15. The article of claim 14, wherein the non-reactive particles include polyurethane pieces.

16. A polishing apparatus, comprising:

a platen;

a layer of polishing material on the platen, the layer of polishing material including a frozen binder material that has a liquid state at room temperature, and solid particles dispersed in the frozen binder material, wherein the solid particles include non-reactive particles that have a Mohs hardness of less than 8; and a carrier to hold a disk shaped substrate with the layer of polishing material in contact with an outer surface of the disk shaped substrate during a planarization process.

17. The polishing apparatus of claim 16 further comprising a thermally insulating cover disposed over the layer of polishing material.

18. The polishing apparatus of claim 16 further including a ring surrounding a periphery of the layer of polishing material.

19. A polishing apparatus, comprising:

a platen;

a layer of polishing material on the platen, the layer of polishing material including a frozen binder material that has a liquid state at room temperature, and solid particles dispersed in the frozen binder material; and a tube embedded in the layer and filled with a cooling liquid.

20. A polishing apparatus, comprising:

a platen;

a layer of polishing material on the platen, the layer of polishing material including a frozen binder material that has a liquid state at room temperature, and solid particles dispersed in the frozen binder material; and a cloth or wire mesh embedded in the layer of polishing material.

21. A chemical mechanical polishing apparatus, comprising:

a polishing layer that includes a frozen binder material that has a liquid state at room temperature, and solid particles dispersed in the frozen binder material, the polishing layer having a polishing surface, wherein the solid particles include non-reactive particles that have a Mohs hardness of less than 8;

a cooling system to maintain the layer in a frozen state; and a carrier head to hold a lower surface of a disk shaped substrate in contact with the polishing surface of the polishing layer.

22. The apparatus of claim 21 further comprising a movable platen supporting the polishing layer.

23. The apparatus of claim 21 further comprising a thermally insulating cover covering the frozen layer and having an opening for accommodating the carrier head.

24. The apparatus of claim 21 further comprising a polishing surface reconditioning device.

25. The apparatus of claim 24 wherein the polishing surface reconditioning device includes an assembly to collect and remove debris from the polishing surface.

26. The apparatus of claim 25 wherein the polishing surface reconditioning device includes a blade to inscribe grooves or ridges in the polishing surface.

27. The apparatus of claim 25 wherein the polishing surface reconditioning device includes a heater to melt the debris.

28. The apparatus of claim 21 further comprising a heater for melting the polishing surface.

29. The apparatus of claim 21 further comprising an optical monitoring device.

30. The apparatus of claim 29 wherein the polishing layer has a transparent area.

31. The apparatus of claim 30 wherein the transparent area of the polishing layer is formed of ice.

32. The apparatus of claim 21 wherein the cooling system includes a tube embedded in the polishing layer to carry a coolant therethrough, and a source to supply the coolant to the tube.

33. The apparatus of claim 21 wherein the disk shaped substrate contains at least one patterned layer used to form integrated circuitry.

* * * * *